US006758332B2

(12) United States Patent
Miller et al.

(10) Patent No.: US 6,758,332 B2
(45) Date of Patent: Jul. 6, 2004

(54) PADDED HARNESS FOR LAPTOP COMPUTERS

(75) Inventors: Jeffrey Randoph Miller, Natick, MA (US); Clifford Jay Spinac, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 118 days.

(21) Appl. No.: 10/047,019

(22) Filed: Jan. 15, 2002

(65) Prior Publication Data

US 2003/0132127 A1 Jul. 17, 2003

(51) Int. Cl.[7] ..... B65D 81/05
(52) U.S. Cl. ..... 206/305; 206/320; 206/591
(58) Field of Search ..... 206/305, 320, 206/521, 523, 583, 586, 591–594, 805

(56) References Cited

U.S. PATENT DOCUMENTS 5,002,184 A 3/1991 Lloyd
5,122,111 A * 6/1992 Sebastian et al. ..... 602/19
5,524,754 A * 6/1996 Hollingsworth ..... 206/320
5,762,250 A * 6/1998 Carlton et al. ..... 206/320
5,775,497 A 7/1998 Krulik
5,819,942 A 10/1998 Sadow
5,857,568 A * 1/1999 Speirs ..... 206/320
5,894,976 A * 4/1999 Harper ..... 224/587
5,931,297 A 8/1999 Weill et al.
6,149,002 A 11/2000 Tiramani et al.
6,179,122 B1 1/2001 Moncrief et al.

* cited by examiner

*Primary Examiner*—Jim Foster
(74) *Attorney, Agent, or Firm*—Mark S. Walker; Streets & Steele; Jeffrey L. Streets

(57) ABSTRACT

A device and a method is provided for protecting a laptop computer or other shock-sensitive electronic devices from impact while being transported within conventional luggage along with personal articles by securing one or more collapsible and lightweight bands of material having external hook and loop fasteners to the laptop computer and securing a plurality of pads along the edges of the electronic device by coupling the pads to the external hook and loop fasteners of the band of material. The pads are secured using a plurality of easily secured and removed straps, such as an elastic band or harness.

9 Claims, 5 Drawing Sheets

PADDED HARNESS FOR LAPTOP COMPUTERS

BACKGROUND OF THE INVENTION

1. Field of the Invention

The present invention generally relates to methods and apparatus for protecting articles during transport, and more specifically to a device for protecting an electronic device such as a portable personal computer.

2. Description of the Related Art

Technological advances have increased the capabilities of portable electronic devices and simultaneously reduced the cost of manufacturing these devices. Consequently, the number of these devices being purchased and carried by consumers has dramatically increased. As portable electronic devices become increasingly favored by consumers, manufacturers continually seek ways of making them even more portable and more durable.

Laptop computers contain delicate electronic and mechanical components that are sensitive to impact. A sharp blow to the edge of a laptop computer can cause internal damage to the hard disk drive and render the unit useless or in need of expensive repair. Furthermore, the computer casing itself can be cracked or transfer the load of an impact to internal components that can become damaged.

Many carrying cases have been designed to carry, protect and store a laptop computer. The problem with existing carrying cases is that they are designed to accommodate the laptop computer and little else. Existing carrying cases are generally full fabric enclosures with some pockets or compartments for carrying small computer-related items such as compact disks, power adapters, floppy disks or ear-phones. Existing carrying cases are generally designed to be carried as an independent piece of luggage, they usually have their own shoulder straps or handles to facilitate carrying, and they are not designed to carry other personal items. Consequently, a person traveling with both a laptop computer and personal items must either carry two separate pieces of luggage, one specifically designed for the laptop computer and another for the personal items, or the person must carry the laptop computer unprotected within a conventional piece of luggage. In the latter instance, the laptop computer is more likely to be damaged by impact. Also, many airlines allow passengers to carry only one piece of luggage on a flight. Thus, the airline passenger may be forced to decide between checking their personal items or checking their laptop computer, and the passenger may not wish to risk losing either their personal items or their laptop. The only alternative is to carry very large pieces of luggage that can accommodate their personal items and their laptop computer stored inside a conventional protective carrying case, and this large piece of luggage may exceed the airline's size restriction for carry-on articles. "Conventional luggage," as that term is used herein, includes backpacks, garment bags, carrying bags, duffel bags, brief cases, purses, suitcases, trunks and the like.

Another problem with existing laptop computer carrying cases is that they are targets for thieves. Dedicated laptop computer carrying cases essentially advertise to criminals that the case contains valuable property. Travelers using existing laptop computer carrying cases are increasingly victimized by computer thieves in airports, trains, public restrooms and other places commonly used by travelers.

Most protective carrying cases specifically made for portable electronic devices are made of rigid exterior components forming a hard outer shell, or from fabric adapted to form an impact-absorbing enclosure, with padding disposed on the inside or outside of the fabric enclosure. These carrying cases form a full enclosure for storing and transporting an electronic device.

What is needed is a device and a method for safely carrying both a laptop computer and personal items in a single piece of conventional luggage. What is needed is a lightweight device designed to secure and protect a laptop computer so that the laptop computer can be inconspicuously carried along with personal articles within a single piece of conventional luggage. It would be desirable if the device was adjustable to fit a variety of electronic articles within a given size range. It would also be desirable if the device could be easily fitted onto the article to be protected, easily removable, lightweight, and collapsible for efficient storage when not secured to the article.

SUMMARY OF THE INVENTION

DETAILED DESCRIPTION

The present invention provides a device and a method for protecting a laptop computer from damage when the laptop computer is carried with other articles within a piece of conventional luggage. The present invention allows a laptop computer to be efficiently and safely carried in conventional luggage, and eliminates having to either carry independent pieces of luggage or carry the laptop unprotected.

The present invention comprises a securing harness for strategically securing impact-absorbing, cushioning or resilient pads at critical points on a laptop computer. Specifically, the present invention provides a securing harness for securing pads along the edges of a laptop computer in the computer's closed and inactive position. While pads may be similarly secured over the top and bottom faces of the laptop, it is preferred to leave the top and bottom of the laptop computer to be protected by strategic placement of other items such as soft clothing, magazines, notebooks or files, within the same piece of luggage. Optionally, the pads may be customized, adapted, molded or formed into a channel designed to receive and protect the edge of a laptop computer. The pads maybe permanently coupled to the securing harness, such as by stitching, or they may be detachable from the harness using a fastener, such as a hook and loop fastener (available under the trade name Velcro®). The pads may be made of any resilient cushioning material including rubber, styrofoam, cardboard, solid polymers, bubble-wrap and other fluid-filled bladders.

Figure 1:
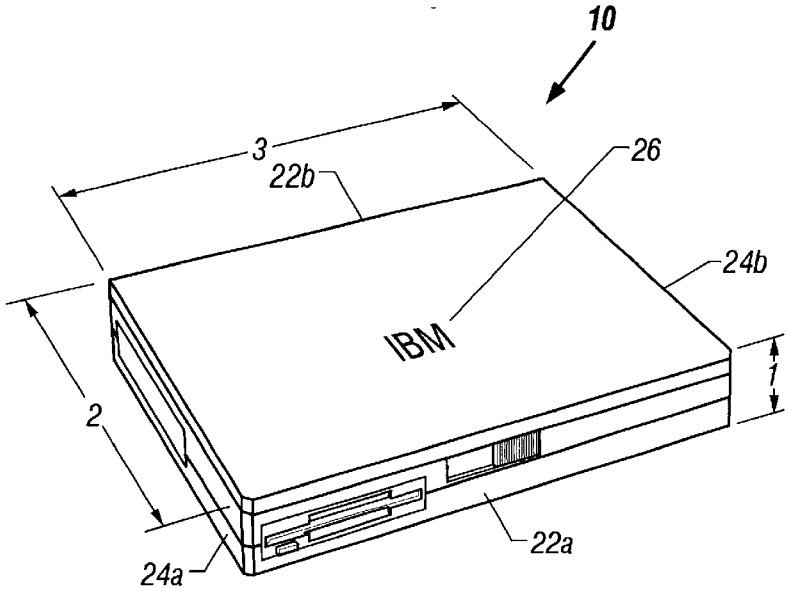
FIG. 1 is a perspective view of a typical laptop computer in a closed condition.

FIG. 1 shows a perspective view of an IBM Think Pad T Series computer 10 in a closed condition. This particular computer has a thickness dimension 1 measuring 1.3 inches, a width dimension 2 measuring about 10.5 inches along the side 24*a* and 24*b*, and a length dimension 3 measuring about 13 inches along the front 22*a* and back 22*b*, all when in the computer's closed position. Although the present invention may easily be adapted for use with portable computers of any shape or dimensions, these dimensions for the current model IBM Think Pad™ T Series computer are provided merely to more specifically describe the present invention.

Figure 2:
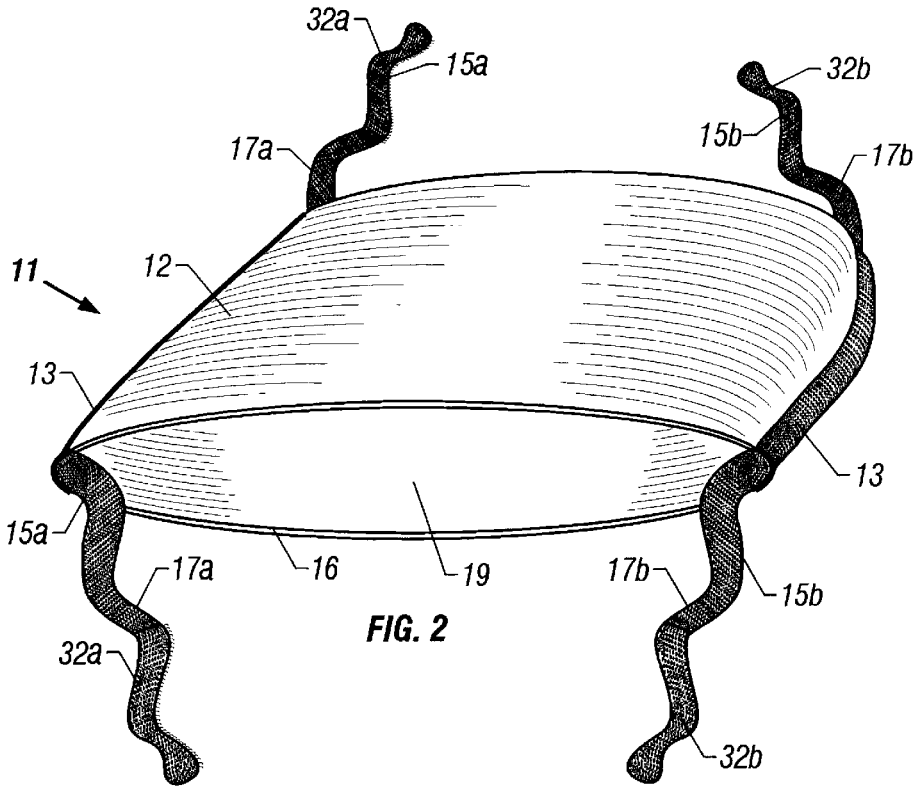
FIG. 2 is a perspective view of a circumferential elastic band-type securing harness having a pair of closure tabs on either side of an opening formed by the band.

FIG. 2 shows one embodiment of a protective device 11 of the present invention for laptop computers, the device having an elastic band-type securing harness 12. The securing harness 12 generally forms a continuous band of elastic material having two openings 16, one on each side of an interior space 19 therebetween, and a relaxed hoop length at least slightly smaller than the lengthwise perimeter (or, alternately, the widthwise perimeter) of the laptop computer 10 (See FIG. 1). The elastic band-type securing harness 12 may be designed to receive the laptop computer 10 within the interior space 19 and snugly fit onto the laptop computer 10 either lengthwise or widthwise, wherein a securing harness 12 designed to fit the widthwise perimeter of the laptop computer 10 may have a smaller relaxed hoop length than a securing harness 12 designed to fit the lengthwise perimeter.

The purpose of the securing harness 12 is to strategically position a plurality of pad fasteners 13 coupled to the outer surface of the securing harness 12 in a manner positionable along the edges of the laptop computer 10. An elastic band-type securing harness 12 designed to fit the lengthwise perimeter of the laptop computer 10 has a distance from one opening 16 of the band to the other, or across the interior space 19, that is less than the width dimension 2 of the laptop computer. Conversely, an elastic band-securing securing harness 12 designed to fit the widthwise perimeter of the laptop computer 10 has a distance from one opening 16 to the other that is less than the length dimension 3 of the laptop computer 10.

The interior space 19 is designed to receive and accommodate the inserted laptop computer 10. The lengthwise perimeter of the IBM Think Pad™ Series T computer is 28.6 inches (13+13+1.3+1.3). Accordingly, the elastic band-type securing harness 12 of the present invention for an IBM Think Pad™ Series T computer would have a relaxed perimeter less than 28.6 inches, and the securing harness 12 must be elastically expanded in the hoop direction to be fitted onto the laptop computer 10. If the elastic band-type securing harness 12 is made from materials having higher elasticity, the relaxed hoop length of the elastic band-type securing harness 12 may be substantially less than the perimeter of the laptop computer 10 that can be accommodated within the interior space 19. Accordingly, the use of higher elasticity materials for the elastic band-type securing harness 12 provide securing harnesses that can be used with a greater size range of laptop computer. Optionally, securing harnesses of a single size could be used for a variety of computer sizes and perhaps for both the lengthwise and widthwise dimensions.

In the embodiment shown in FIG. 2, the pad fasteners 13 comprise two strips of either hooks or loops (one side or the other of a hook and loop fastener arrangement) coupled to the outer surface of the securing harness 12 at generally opposing positions on the band. Preferably, each of the pad fasteners 13 is oriented generally perpendicular to the hoop direction of the securing harness 12 and generally perpendicular to the plane of at least one opening 16. In the preferred embodiment, the pad fasteners 13 are secured to the securing harness 12 along a portion of their length by stitching.

In the embodiment of the present invention shown in FIG. 2, the pad fasteners 13 comprise an elongated strip of hooks or loops that are substantially longer than the distance across the interior space 19 of the securing harness 12, but are secured to the securing harness 12 along only a portion of their length, the excess portions beyond the opening 16 thereby forming closure tabs 15*a* and 15*b* on each side of opening 16. The closure tabs 15*a* and 15*b* are formed by the excess end portions of the pad fasteners 13 that extend beyond the plane of opening 16 of the securing harness 12.

The closure tabs 15*a* and 15*b* can be pulled to fit the securing harness 12 onto the laptop computer 10. The closure tabs 15*a* and 15*b* are adapted to secure one tab to the other tab using hook and loop fasteners, such as Velcro® strips, applied to interfacing sides of end portions 32*a* and 32*b* of closure tabs 15*a* and 15*b*, respectively, and to present an outwardly facing pad fastener (either hooks or loops) to facilitate the securing of pads across the edge of the laptop computer 10 adjacent to opening 16. The outwardly facing pad fastener is provided by, for example, disposing hooks along the outwardly disposed side of end portion 32*a* of the first closure tab 15*a* for securing to loops disposed along the inwardly disposed side of end portion 32*b* of the second closure tab 15*b* that is positioned generally opposite the first closure tab 15*a* across opening 16. When the hook fastener of the outwardly disposed side of end portion 32*a* of the first closure tab 15*a* is secured to the inwardly disposed side of end portion 32*b* of the second closure tab 15*b*, the outwardly disposed side of end portion 32*b* of the second closure tab 15*b* is brought generally into alignment with the interior portion 17*a* of the first closure tab 15*a*.

Figure 3:
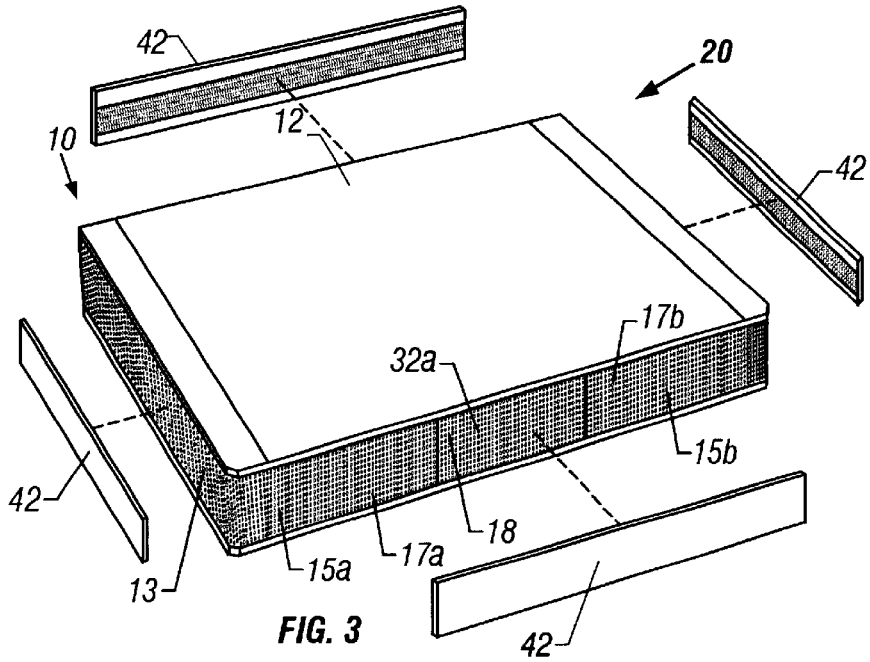
FIG. 3 is a perspective view of a circumferential elastic band-type securing harness with pad fasteners installed on a laptop computer without the detachable pads applied to the fasteners.

A hook or loop fastener is disposed along both the outwardly disposed side of the interior portion 17*a* of the first closure tab 15*a* and along the outwardly disposed side of the interior portion 17*b* of the second closure tab 15*b*. FIG. 3 shows a closure tab fastener 18 that is formed by securing the inwardly disposed side of end portion 32*a* to the outwardly disposed side of end portion 32*b*. The resulting closure tab fastener 18 thereby provides hooks or loops for receiving and coupling to loops or hooks, respectively, disposed along pads 42 for securing the pads 42 to the securing harness 12. When the securing harness 12 is installed onto the laptop computer 10 and the end portions 32*a* and 32*b* of the closure tabs 15*a* and 15*b*, respectively, are joined one to the other using hook and loop fasteners on end portions 32*a* and 32*b*, the pad fasteners 13 and closure tab fastener 18 are strategically positioned to align along the edges of the laptop computer 10 as shown in FIG. 3. Coupling closure tab 15*a* to closure tab 15*b* across the opening 16 after fitting the securing harness 12 onto the laptop computer 10 secures the pad fasteners 13 and the closure tab fastener 18 to the laptop computer 10 for coupling of pads 42 thereto.

Since only one access opening 16 into the interior space 19 of the securing harness 12 is needed for fitting the securing harness 12 onto the laptop computer 10, a strip of fabric having hooks or loops similar to that disposed along the pad fasteners 13 maybe disposed along the outwardly disposed side of the fabric strip. The fabric strip maybe permanently secured across one of the openings 16 of the securing harness 12, leaving one opening 16 with closure tabs 15*a* and 15*b* for fitting and removing the securing harness 12.

As shown in FIG. 2, closure tabs 15*a* and 15*b* themselves may have hook and loop fasteners, such as Velcro® strips, disposed along their end portions 32*a* and 32*b* for securing one to the other across the opening 16 and for securing the securing harness 12 onto the laptop computer 10. Outwardly exposed hooks or loops on the closure tab fastener 18 align with the pad fasteners 13 for securing pads along each edge of the laptop computer 10. The pad fasteners 13 maybe segmented or substantially continuous. Furthermore, the pad fasteners 13 around the perimeter of the laptop computer 10 maybe coupled to one or more detachable pads 42 having loops (for pad fasteners having hooks) or hooks (for pad fasteners having loops).

Figure 4:
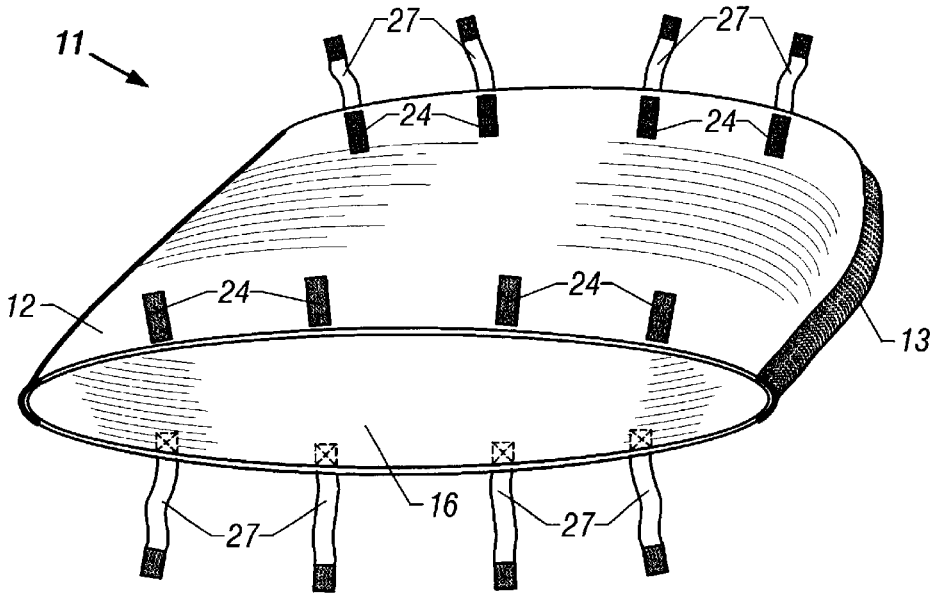
FIG. 4 is a perspective view of an elastic band-type securing harness having closure straps on either side of an opening formed by the band.

In an alternate embodiment shown in FIG. 4, the securing harness 12 may be secured to the laptop computer 10 (see FIG. 1) using a plurality of closure straps 27 secured along to the securing harness 12 along the bottom side of opening 16 and an equal number of strap fasteners 24 secured at generally opposite positions therefrom along the top side of opening 16. After the securing harness is fitted onto the laptop computer 10, the closure straps 27 extend across the opening 16 to fasten to strap fasteners 24 using hook and loop fasteners. In addition to the fasteners securing closure straps 27 to fasteners 24, hook or loop fasteners are disposed along the outwardly exposed sides of closure straps 27 such that when the closure straps 27 are fastened across opening 16 to secure the securing harness 12 to the laptop computer 10, the outwardly exposed hook or loop fasteners may receive and couple to pads having hooks (for closure straps 27 having loops) or loops (for closure straps 27 having hooks).

Figure 5:
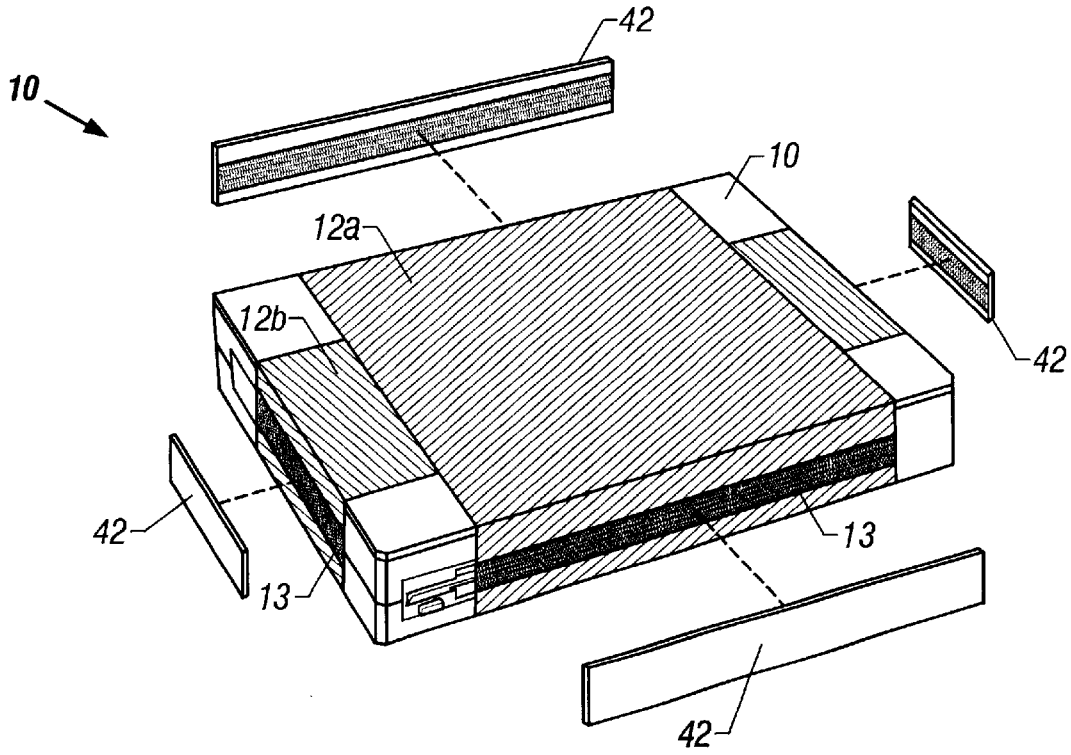
FIG. 5 is a perspective view of an elastic band-type securing harness having two perpendicular elastic bands installed on a laptop computer with detachable pads applied to the elastic bands.

An alternate embodiment of the present invention shown in FIG. 5 comprises two continuous elastic band-type securing harnesses 12*a* and 12*b* fitted onto the laptop computer 10, one installed perpendicular to the other. A widthwise-securing harness 12*a* may position elongated pad fasteners 13 along the front and back of the laptop computer 10, and a lengthwise securing harness 12*b* may position elongated pad fasteners 13 along the sides of the laptop computer 10. This arrangement eliminates the need for the closure tabs 15*a* and 15*b* of the embodiment shown in FIG. 2, or closure straps 17 and strap fasteners 24 of the embodiment shown in FIG. 4, in order to position pad fasteners 13 along the front 22*a* and back 22*b* of the laptop computer 10 left exposed by a single band securing harness. The dual band harness shown in FIG. 5 illustrates securing four separate and detachable pads 42.

Figure 6:
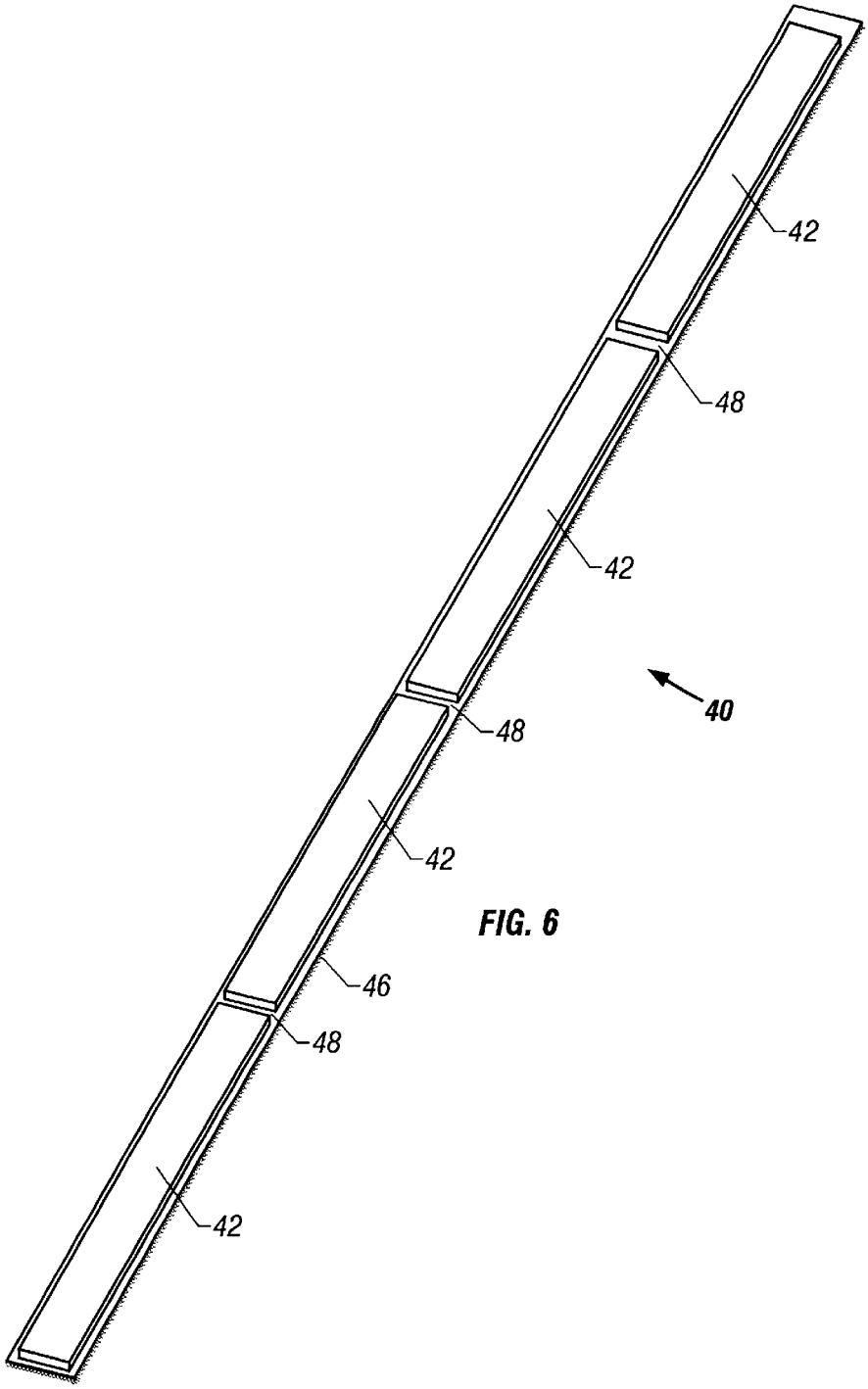
FIG. 6 is a perspective view of one embodiment of linked detachable pads.
Figure 7:
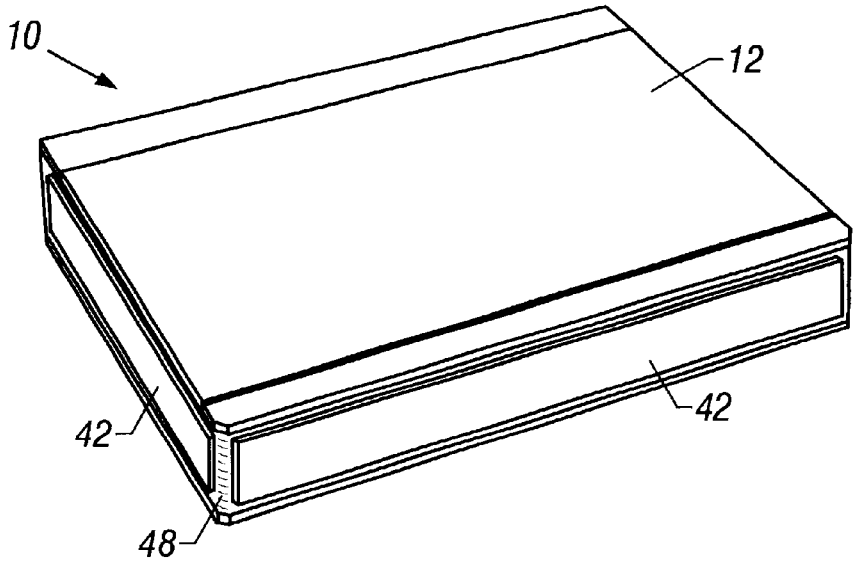
FIG. 7 is a perspective view of the securing harness with the detachable pads coupled to pad fasteners on a securing harness installed on a laptop computer.

FIG. 6 shows one embodiment of linked pads 40 that can be used in conjunction with the securing harness 12 (see FIG. 2) to protect the edges of a laptop computer 10 (see FIG. 1) from impact damage. The linked pads 40 comprise four elongated pads 42, each adapted to protect one or more edges of the laptop computer 10 when the computer is closed and fitted with the securing harness 12. In this embodiment, a strip 46 of either hooks or loops is stitched generally lengthwise along the back and center of linked pad 40 for coupling to the pad fasteners 13 and/or closure tab fastener 18 of the securing harness 12. In this embodiment, each pad 42 may be flexibly coupled at one or more ends to at least one other pad 42 by a fabric-linking strap 48. FIG. 7 shows an elastic band-type securing harness 12 installed on a laptop computer 10 with detachable linked pads 40 coupled to the pad fasteners 13.

In the embodiments described thus far, the pads 42 are detachable from the securing harness 12. This configuration provides easier installation of the securing harness 12 and easy replacement of detachable pads 42 when worn. Also, the use of detachable pads that are easily bent into a right angle to conform to the corner of a laptop computer 10 affords greater adaptability of the computer padding system of the present invention to laptop computers of different sizes. For example, the elastic band-type securing harness 12 may accommodate only three detachable pads 42 to protect the entire perimeter of a small laptop computer 10, but may require four detachable pads 42 to protect the entire perimeter of a larger laptop computer 10 fitted with the same securing harness 12. In an alternative embodiment, the pads 42 are permanently secured to the securing harness 12, thereby eliminating the need for pad fasteners 13 to detachably secure pads 42 to the securing harness 12. In this embodiment, the preferred method of securing pads 42 to the securing harness 12 is stitching.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

We claim:

1. A method of packing a laptop computer within luggage comprising:

securing a flexible harness around an entire circumference of the laptop computer;

coupling a plurality of shock absorbing pads onto an exterior of the harness, wherein the pads are therefore secured to the harness around at least a portion of a circumferential edge of the laptop computer when closed; and disposing the laptop computer with the luggage.

2. A device for protecting a laptop computer having a circumferential edge when closed, the device comprising:

a sleeve encircling the laptop computer and open at a first end and a second end;

closure tabs on the sleeve covering a portion of the circumferential edge not covered by the sleeve, wherein the closure tabs are adapted for closing the first end and the second end of the sleeve;

a plurality of shock absorbing pads being secured to the sleeve around a portion of the circumferential edge covered by the sleeve; and one or more shock absorbing pads being secured to the closure tabs.

3. The device of claim 2, wherein the sleeve comprises elastic.

4. The device of claim 2, wherein the plurality of shock absorbing pads are removably secured to the sleeve using hook and hoop fasteners.

5. The device of claim 2, wherein the plurality of shock absorbing pads are permanently secured to the sleeve.

6. The device of claim 2, wherein the plurality of shock absorbing pads comprise a resilient cushioning material.

7. A device for protecting a laptop computer having a circumferential edge when closed, the device comprising:

a sleeve open at least at a first end, wherein the sleeve is encircling the laptop computer;

first closure tabs on the sleeve being adapted for closing the first end of the sleeve, wherein the closure tabs are covering a portion of the circumferential edge not covered by the sleeve;

a plurality of shock absorbing pads being secured to the sleeve around a portion of the circumferential edge covered by the sleeve; and one or more shock absorbing pads being secured to the first closure tabs.

8. The device of claim 7, wherein the sleeve is open at a second end, the device further comprising:

second closure tabs on the sleeve being adapted for closing the second end of the sleeve, wherein the second closure tabs are covering a portion of the circumferential edge not covered by the sleeve; and one or more shock absorbing pads being secured to the second closure tabs.

9. The device of claim 7, wherein the sleeve comprises elastic.

* * * * *